US012428107B1

(12) United States Patent
Kristinsson et al.

(10) Patent No.: US 12,428,107 B1
(45) Date of Patent: Sep. 30, 2025

(54) MODULAR KEEL

(71) Applicant: RAFNAR EHF, Reykjavik (IS)

(72) Inventors: Ossur Kristinsson, Reykjavik (IS); Owen Mark Langdon, Glasgow (GB); Pall Einarsson, Reykjavik (IS); Daniel Kvernoy, Eivindvik (NO)

(73) Assignee: RAFNAR EHF, Reykjavik (IS)

( * ) Notice: Subject to any disclaimer, the term of this patent is extended or adjusted under 35 U.S.C. 154(b) by 0 days.

(21) Appl. No.: 19/016,768

(22) Filed: Jan. 10, 2025

Related U.S. Application Data

(63) Continuation of application No. 18/949,351, filed on Nov. 15, 2024.

(51) Int. Cl.
*B63B 3/38* (2006.01)

(52) U.S. Cl.
CPC ..... *B63B 3/38* (2013.01)

(58) Field of Classification Search
CPC .... B63B 1/00; B63B 1/02; B63B 1/04; B63B 3/38
See application file for complete search history.

(56) References Cited

U.S. PATENT DOCUMENTS

| | | | | |
|---|---|---|---|---|
| 3,225,729 | A | 12/1965 | Ewing, Jr. | |
| 3,698,342 | A * | 10/1972 | Jackson | B63B 1/18 114/291 |
| 4,753,184 | A | 6/1988 | Schiavone | |
| 5,394,819 | A | 3/1995 | Aarnio | |
| 5,497,722 | A | 3/1996 | English, Sr. | |
| 8,567,332 | B1 | 10/2013 | Bassler et al. | |
| 8,726,823 | B2 | 5/2014 | Kristinsson | |
| 9,038,561 | B2 | 5/2015 | Loui et al. | |
| 9,365,262 | B1 | 6/2016 | Almeter | |
| 9,751,594 | B2 | 9/2017 | Rickborn | |
| 10,059,405 | B2 | 8/2018 | Rickborn | |
| 10,518,842 | B1 | 12/2019 | Kyle et al. | |
| 11,479,325 | B1 | 10/2022 | Schexnaider | |

FOREIGN PATENT DOCUMENTS

| | | | |
|---|---|---|---|
| AU | 2022219213 | A1 | 9/2023 |
| EP | 3303113 | B1 | 8/2023 |
| GB | 2571960 | A | 9/2019 |
| IT | 1398307 | B1 | 2/2013 |
| JP | H08332991 | A | 12/1996 |
| JP | 2022119343 | A | 8/2022 |
| KR | 20100113800 | A | 10/2010 |
| RU | 2534498 | C1 | 11/2014 |
| WO | 2007041809 | A1 | 4/2007 |
| WO | 2009116870 | A1 | 9/2009 |

* cited by examiner

*Primary Examiner* — Anthony D Wiest
(74) *Attorney, Agent, or Firm* — Workman Nydegger

(57) ABSTRACT

A modular keel is arranged along a centerline of a boat hull for displacing a bow wave towards the stern and creating distinct pressure zone situations to draw the keel back into water and reduce pitching. The keel features a base extending along a centerline of the boat hull and two symmetric curved segments. The base tapers toward a vertex on the centerline at a fore transitional area that generates a concentrated high pressure zone to help lift the hull and reduce pitching. The keel includes an aft transitional area for expelling water away from the keel in a laminar flow pattern during forward movement of the boat hull. The keel further includes an intermediate transitional area that creates a low pressure zone to dampen the motion of the hull through waves.

20 Claims, 8 Drawing Sheets

MODULAR KEEL

FIELD OF DISCLOSURE

The present disclosure relates to a modular keel for a hull of a watercraft.

BACKGROUND

Boat designs have constantly evolved for thousands of years. The innovation of various propulsion systems, hull materials, and other technologies has contributed to many improvements in boat designs over the past several decades. However, the sea continues to present a host of problems to boats traveling along the surface. Specifically, problems relating to the hydrodynamic flows and the forces exerted on the submerged portion of the boat present challenges to conventional boats attempting to navigate through rough seas.

Waves can be dangerous obstacles that are powerful enough to roll a vessel to its side or swamp a boat with water. Slamming is defined as the impact of the bottom structure of a boat against the sea surface. When sailing in waves, the bow will raise from the water and subsequently impact or 'slam' onto the sea surface. Slamming induces high loads to boat structures and causes accelerations to the boat itself, equipment, and people onboard. Different boats will have different responses to waves and slamming.

In terms of marine engineering, boat hulls may be classified as a "displacement" type, where the buoyancy of the boat is achieved fully through displacement of a corresponding weight of water, or a "planing" or "semi-planing" type which, while supported by displacement of water at standstill or slow speeds, generate lift by hydrodynamic forces acting on the hull at higher speeds such that the hull is supported to varying degrees on the bow wave. Thus, planing boats can reach higher speeds than displacement boats with reasonable propulsion power demands due to reduced drag on the hull under planing conditions.

Typical planing boats raise their bow when accelerating which results in a loss of visibility from the helm position. The vertical displacement also results in unwanted movement of non-secure items inside the boat. When traveling at full speed and performing a full turn with a planing boat, the boat may slip or skid, resulting in danger to passengers on board and loss of maneuverability.

Moreover, boats and ships suffer extra energy usage when traveling through rough waters, i.e., boats experience greater resistance against waves in the form of hydrodynamic drag. Slamming can also result in voluntary speed reduction for boats sailing in rough water seas. Boats may choose to avoid a heavy weather area; however, this can impact the arrival time of the boat and affect the fuel economy.

SUMMARY

The inventors of the present disclosure have identified a modular keel for a boat hull that cleaves through the water even in rough sea conditions. The modular keel allows for the boat to remain planed by directing bow waves toward the back of the boat and creating an advantageous low-pressure condition along the keel that draws the boat back into the water, thereby reducing and mitigating harmful accelerations during aggressive slamming events.

The keel is arranged along a centerline of a boat hull for displacing a bow wave towards the stern and creating distinct pressure zone situations to draw the keel back into water. The modular keel is defined as a curvilinear deflection arranged to extend from the waterlines and buttock lines of the hull i.e., in the transverse and central planes of the hull. The deflection creates a concentrated high pressure zone in front of the keel, a low pressure zone through the middle area of the keel, and a high pressure zone aft of the keel. The pressure differential in each zone is dependent on the amount of curvature that is added to the specific area of the keel. Similar pressure zones are also created on the surrounding hull surface as a result of the keel configuration and said similar pressure zones may be manipulated depending on the specific application of the hull. The pressure zone situations created by the modular keel help to both dampen the motion of the hull through waves and reduce pitching.

The forward transition zone of the modular keel is optimized to reduce slamming and spray, the aft transition is optimized to avoid high pressure concentrations. The central low-pressure zone is optimized for speed and sea keeping requirements. The hull side transition zone is optimized for displacement, buoyancy distribution and transverse stability. As a result, the low pressure zone helps to dampen the motion of the hull through waves and the high pressure zones help to lift the hull and reduce pitching. In some instances, the aft high pressure zone can also be manipulated to create a forward thrust component as well as lift.

The keel features a base extending along a centerline of the boat hull and two opposing, symmetric curved segments. The base tapers aft to fore along the centerline toward a vertex. The curved segment is defined as a variable arcuate surface that tapers. In an embodiment, each curved segment is defined between an edge of the base and an arcuate contour. The curved segment laterally extends from the vertex toward a stern substructure.

The arcuate contour converges with the edge in a transitional area at or proximate to the stern substructure (e.g., planar facet). The streamline effect created by the transitional area reduces drag and improves the distribution of the pressure zones between the bow and stern of the boat. When water hits the front part of the dual circular curved areas, below the waterline, the water is forced to exit the dual circular curved area in a laminar flow pattern toward the stern. The keel thus helps to significantly reduce the wave resistance against the boat.

The base forms a trough, which is defined as the bottommost extremity of the keel. The trough is arranged between and below vertex and the stern substructure. In an embodiment, the trough is coplanar with a lateral apex of the arcuate contour in a traverse plane. The curved segment may have a concave-down or concave-up profile. In embodiments where the curved segment features a concave-down profile, the curved segment may be defined as a paraboloid surface with a maximum point being amidship and coplanar with the trough of the base and lateral apex of the arcuate contour. Likewise, in embodiments where the curved segment is concave-up, the curved segment may be defined as a paraboloid surface with a minimum point being lateral to and above the trough of the base and also coplanar with both the trough of the base and lateral apex of the arcuate contour.

In an embodiment, at the transitional area, the base has a maximum thickness that is equal to a width of a planar facet. The planar facet forms part of the stern substructure. The thickness of the base is defined between two edges. The width of the planar facet may be homogenous and defined between two lower surfaces. The two edges begin at the vertex and extend lengthwise astern toward the planar facet. The edges are substantially parallel at the transitional area such that the base aligns and integrates with the planar facet.

The integration allows for water contacting the front of the keel and following the curved segments to be displaced at the back of the keel in a laminar flow pattern. The continuous extension of the edges toward the stern substructure and convergence with the stern substructure, i.e., peripheries of the planar facet, provides the improved laminar flow pattern of water toward the stern.

The keel may also be combined with feature elements, such as chines, spray rails, and/or strakes formed on the hull. The configuration of feature elements for improved stability, aiding in lift, and deflecting spray when the boat is planing. Various choices of curvature for the opposing curved segments will determine the hull configuration in accordance with the disclosed modular keel so that hull performance and displacement characteristics can be designed and optimized for any desired boat configuration.

The modular keel may be adapted to fit hulls of various types and sizes, e.g., V-shaped hull, flat bottom hull, displacement hull, planing hull, multihull, round bottom hull, catamaran hull, pontoon hull, cathedral hull, or trimaran hull. The modular keel may also be adapted as a twin keel on a single hull. In a single-hull embodiment, the vertex may be arranged between 15% and 30% down a length of the hull waterline, while the aft transitional area may be arranged between 60% and 85% down a length of the hull waterline. In an embodiment, the intermediate transitional area may be located between 35% and 60% down a length of the hull waterline.

These and other features, aspects, and advantages of the present disclosure will become better understood regarding the following description, appended claims, and accompanying drawings.

BRIEF DESCRIPTION OF THE DRAWINGS

The drawing figures are not necessarily drawn to scale, but instead are drawn to provide a better understanding of the components thereof, and are not intended to be limiting in scope, but to provide exemplary illustrations. The figures illustrate exemplary configurations of a modular keel integrated with a boat hull, and in no way limit the structures or configurations according to the present disclosure.

DETAILED DESCRIPTION OF VARIOUS EMBODIMENTS

Figure 1:
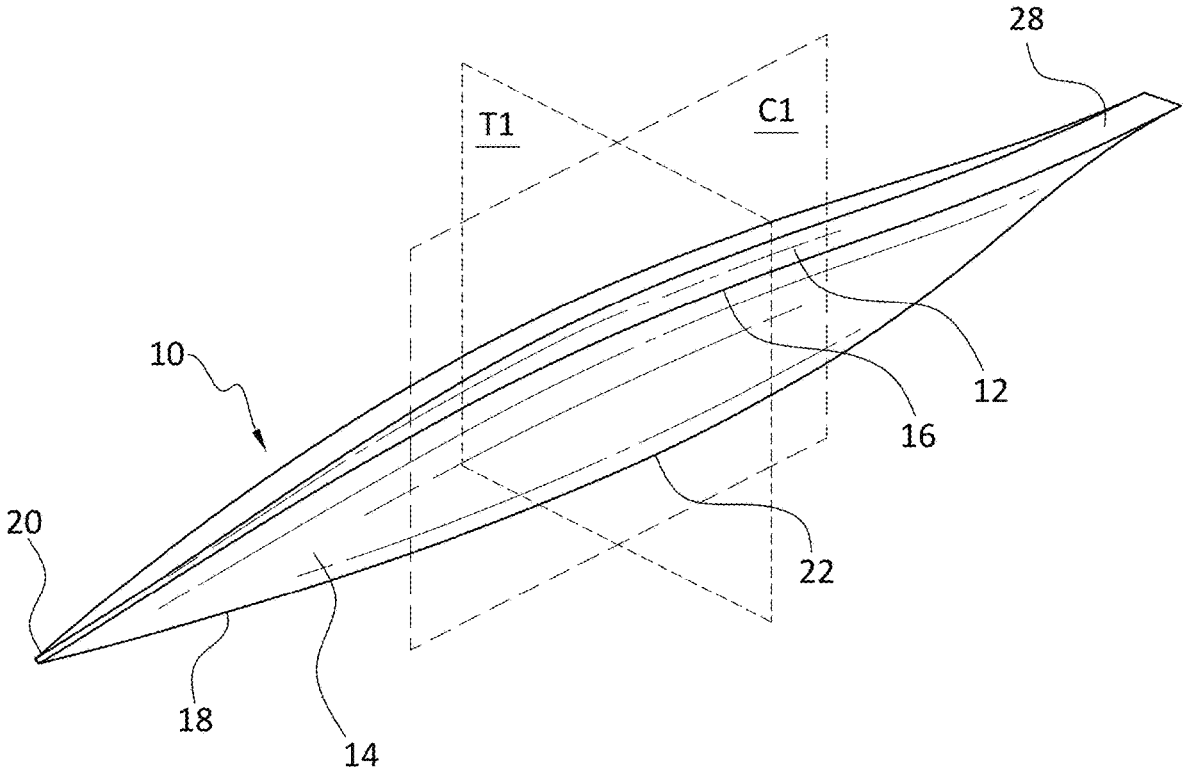
FIG. 1 is a perspective view of the modular keel.

FIG. 1 illustrates a perspective view of a modular keel 10. The keel 10 comprises a curved base 12 along a center plane C1 and two symmetric curved segments 14 adjacent to the base 12. The modular keel 10 exhibits reflectional symmetry with the center plane C1 such that reference to one side also applies to the opposing side, wherein the center plane C1 is perpendicular to a transverse plane T1 of the modular keel 10. The base 12 includes opposing edges 16 that taper toward and intersect at the vertex 20 in the center plane C1. The continuous extension of the edges 16 toward a rear planar facet 28 provides an improved laminar flow pattern of water along the keel 10 and any surrounding hull structure. The modular keel 10 forms an intermediate transitional area between the vertex 20 and rear planar facet 28 (or rear area of the corresponding hull) to create a low pressure zone along the middle section of the keel 10 and to dampen the motion of a corresponding hull through the waves.

The curved segment 14 is defined between an edge 16 of the base 12 and an arcuate contour 18 of the keel 10. Each curved segment 14 arcuately and laterally extends from the vertex 20 toward the planar facet 28. The apex 22 of the arcuate contour 18 is athwartship to the center plane C1 arranged between the vertex 20 and planar facet 28.

Figure 2:
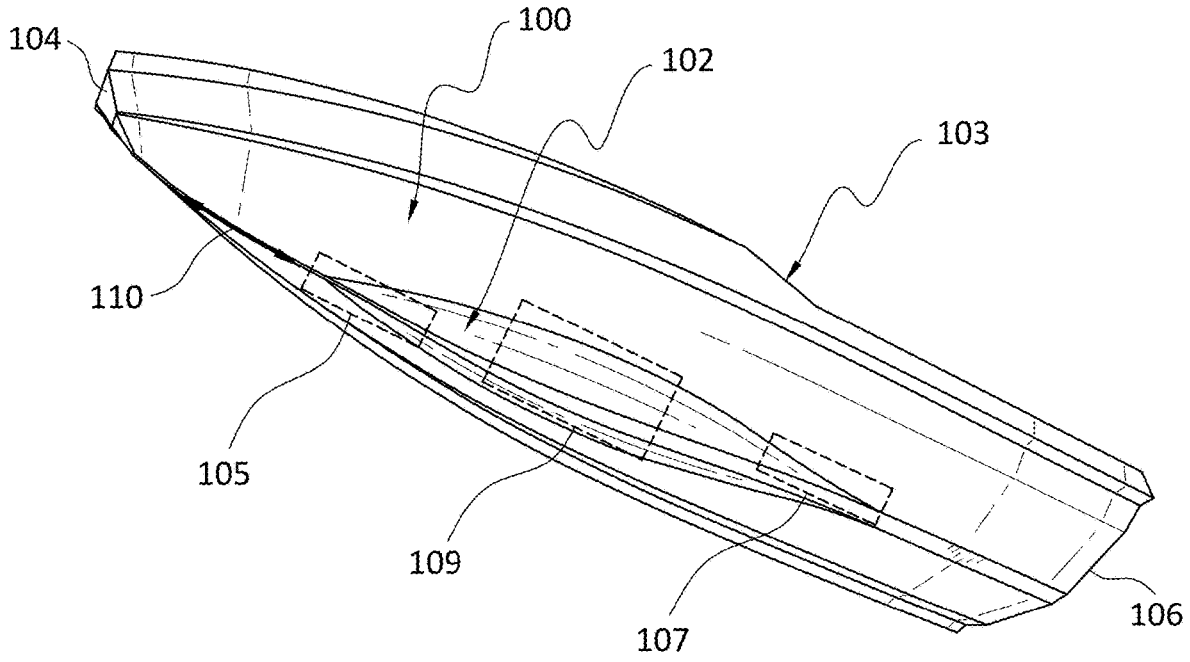
FIG. 2 is a perspective view of a boat hull having a modular keel.

FIG. 2 shows a perspective view of a modular keel 102 integrated with a body 103 of a boat hull 100. In general, the term 'boat' refers to a watercraft or other vessel that travels on water. Reference to hulls or keels of a boat likewise apply to other types of marine vessels and is not intended to limit the disclosure to a specific type of watercraft. The keel 102 is formed along and symmetrical about a longitudinal centerline 110 of the hull 100. The keel 102 advantageously works by displacing bow waves towards the back of the keel 102, creating distinct pressure zone situations with transitional areas 105, 107, 109, pulling the keel 102 back into the water, and reducing and mitigating vertical motions that would otherwise aggressively slam traditional vessels downward against the sea surface. The keel 102 provides improved, streamlined transitional areas 105, 107, 109 that direct the flow of water from the bow 104 toward the stern 106 of the hull 100, reduce hydrodynamic resistance, and displace the water at the back of the keel 102 in a laminar flow pattern.

The fore transitional area 105 is optimized to reduce slamming and spray. The intermediate transitional area 109 is arranged between fore and aft transitional areas 105, 107 and is optimized for speed and sea keeping requirements. The intermediate transitional area 109 creates a low pressure zone along the middle section of the keel 102 to dampen the motion of the hull 100 through the waves. The aft transitional area 107 is optimized to avoid high pressure concentrations while still creating a high pressure zone to lift the corresponding hull and reduce pitching. In an embodiment, the aft transitional area 107 is configured and dimensioned to create lift with minimal drag. The distance between pressure zones (i.e., keel length) and the location on the hull is also a critical part of the hull's optimization to creating ideal pressure zone areas for the hull modified with the modular keel 102.

Similar pressure zones may also be created on the surrounding hull surface (e.g., hull side 108) and can be manipulated depending on the hulls purpose. In an embodiment, the high pressure zones created by the fore and aft transitional areas 105, 107 can also be manipulated to create a forward thrust component in addition to lift. While the transitional areas are marked as distinct areas along the keel embodiments in the figures, the transitional areas may overlap i.e., the fore transitional area merges with the intermediate transitional area and the intermediate transitional area merges with the aft transitional area.

The interaction force is caused by transitional areas 105, 107, 109, i.e. their distribution around the immersed keel. During forward movement of the hull, discrete high and low pressure zones appear around and below the keel. The resulting pressure zones result from different velocities of water flowing between transitional areas from fore to aft. The exact pressure distribution against the keel and surrounding hull will depend on keel features (e.g., curvature, length, width, height), speed, acceleration, and generated wave patterns. Thus, the modular keel 102 may be tailored to fit applications for various types of hulls.

By way of non-limiting examples, the hull 100 may generally be configured as a planing hull, including flat bottom, shallow-V, and deep-V hull configurations being adapted with the modular keel 102. The hull 100 may also generally be configured as a displacement hull, including rounded, arched, or semi-displacement hull configures being adapted with the modular keel 102. The keel 102 may be adapted to fit hulls of various types and sizes, e.g., V-shaped and catamaran designs, and may also be adapted as a twin keel on a single hull. In an embodiment, the keel 102 is adapted to fit one of the following designs: deep V hull, flat bottom hull, displacement hull, planing hull, multihull, round bottom hull, catamaran hull, pontoon hull, cathedral hull, or trimaran hull.

Regardless of the configuration of the hull 100, the keel 102 produces ideal pressure zones and helps to break the water for a smoother landing when lifted out of the water.

After wave impacts, the keel 102 reduces pitching up moments that are commonly associated with fast planning crafts. The keel 102 also reduces the amount of the hull body 103 area that is exposed to oncoming waves. Moreover, the keel 102 aids in reducing harmful accelerations experienced by crew and equipment.

As noted, the keel 102 is arranged to draw the hull 100 down into the water and prevents the hull 100 from lateral drifting or sliding along the sea surface. The keel 102 acts as pivot point to minimize turning radius at speed i.e., the keel 102 exhibits a reduced tendency to slide or bounce through high speed maneuvers. The keel 102 advantageously counteracts longitudinal center of gravity changes imposed on the hull 100.

Figure 3:
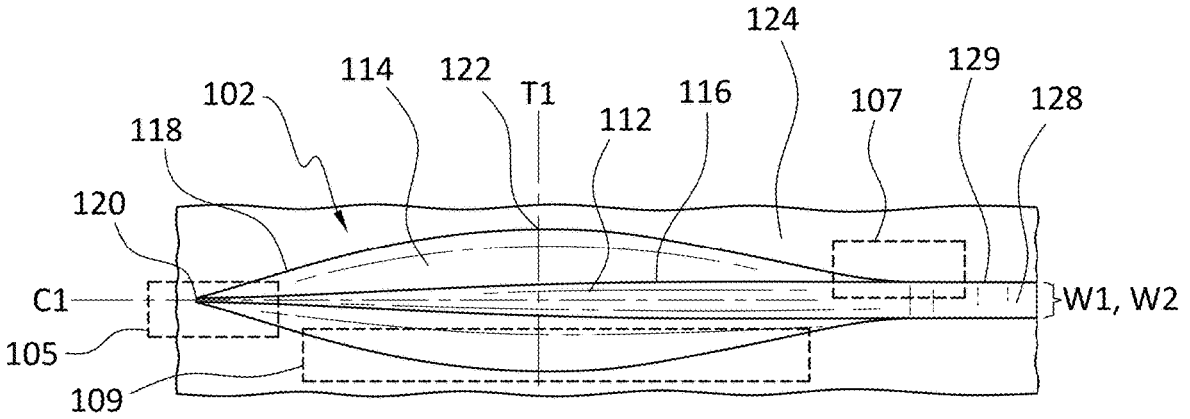
FIG. 3 is a bottom plan view of the modular keel.

FIG. 3 illustrates an embodiment of the modular keel 102. The keel 102 comprises a curved base 112 along the centerline 110 and two symmetric curved segments 114 adjacent to the base 112. The base 112 is curved in a center plane C1, which is coplanar with the centerline 110 of the hull 100. It should be understood that, as the modular keel 102 is symmetric about the centerline 110, reference to one side e.g., symmetric curved segment 114, also applies to the opposing side. The base 112 tapers toward the bow 104 and includes opposing edges 116 that intersect at the vertex 120 on the centerline 110. The continuous extension of the edges 116 toward the stern substructure 132 and convergence with peripheries 129 of the planar facet 128 provides the improved laminar flow pattern of water toward the stern 106.

In an embodiment, the vertex 120 is located between 15% and 30% down (i.e., in a direction from bow to stern) a length L1 of the waterline, while the aft transitional area 107 is arranged between 60% and 80% down a length L1 of the waterline. In an embodiment, the base 112 has a thickness W1 equal to a width W2 of the planar facet 128 at the aft transitional area 107. In an embodiment, the intermediate transitional area 109 may be located between 35% and 60% down a length L1 of the waterline. The waterline length L1 is generally defined as length of the hull at the waterline (abbreviated to L.W.L) at the level where it sits in the water (the waterline). In particular, the waterline length L1 is based on the intended water line when the vessel is afloat in a normal position. The waterline length L1 is defined during the design phase of the hull or vessel for a determined condition of load and distribution.

The curved segment 114 is defined between an edge 116 of the base 112 and an arcuate contour 118 of the keel 102. Each curved segment 114 arcuately and laterally extends from the vertex 120 toward the planar facet 128. In an embodiment, the arcuate contour 118 defines a boundary between the keel 102 and the hull body 103. Alternative embodiments include the boundary of the keel 102 and hull body 103 extending athwartship from the arcuate contour 118. In an embodiment, each opposing curved segment 114 has a greater curvature proximate to a trough 130 of the base 112 than to the vertex 120. The arcuate contour 118 is arranged to converge with the edge 116 of the base 112 in the aft transitional area 107 at the stern substructure 132. In an embodiment, the arcuate contour 118 is substantially asymptotic with the base 112 in the aft transitional area 107. The arcuate contour 118 may blend with the periphery 129 of the planar facet 128, the periphery 129 being adjacent to a stern substructure 132. Thus, the improved aft transitional area 107 is formed by the convergence of the edge 116 of the base 112, the arcuate contour 118 of the curved segment 114, and the periphery 129 of the planar facet 128. In an embodiment, the planar facet 128 aft planar facet is arranged to transition into a propeller tunnel or propulsion system area.

The modular keel 102 facilitates a reduced pitching moment that lowers the induced drag in sea states. For example, when analyzing the same hull proportions with and without keel, an approximate reduction of 34% in pitch was observed at 40 knots (i.e., hull with modular keel featured approximately 2.12° pitch, while the same hull without the modular keel featured approximately 2.84° pitch. Thus, the modular keel facilitates a significant reduction in pitch. The base 112 and curved segments 114 allow for an optimized shape for the hull 100 to traverse through waves; thus, when considered over an average transit, fuel consumption may be reduced. The accelerated flow around keel, provided by the base 112 and curved segments 114, generates an added thrust aspect to counteract the impact of waves hitting hull.

Figure 4:
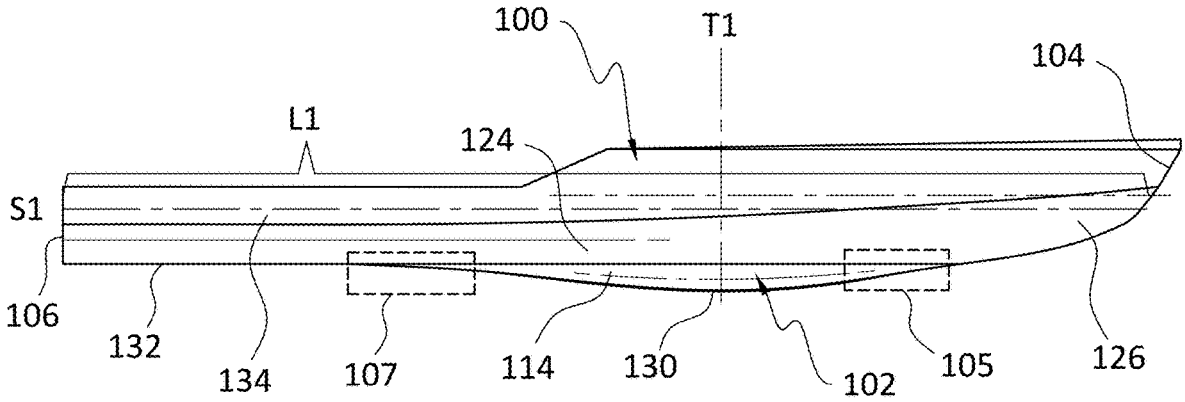
FIG. 4 is a side view of the boat hull with the modular keel.

Referring to FIGS. 3 and 4, the keel 102 includes a trough 130 formed along the base 112. The trough 130 is defined as the bottom-most extremity of the keel 102 along the centerline 110. In an embodiment, the trough 130 is coplanar with an apex 122 of the arcuate contour 118 in a traverse plane T1. The traverse plane T1 is defined as perpendicular to both the center plane C1 and the design waterline plane S1. The apex 122 of the arcuate contour 118 is athwartship to the centerline 110 arranged between the vertex 120 and aft transitional area 107. The trough 130 and curved segments 114 may be modified (i.e., raised or lower, narrowed or expanded) to achieve a desired pressure differential underneath the hull 100. Similarly, the tapering of the base 112 may be customized depending on the application of the hull 100.

The curved segment 114 may have a concave-down or concave-up profile. In embodiments where the curved segment 114 features a concave-down profile, the curved segment 114 may be defined as a paraboloid surface with a maximum point being amidship and coplanar with the trough 130 of the base and lateral apex of the arcuate contour 118. Likewise, in embodiments where the curved segment 114 is concave-up, the curved segment 114 may be defined as a paraboloid surface with a minimum point being lateral to and above the trough of the base 112 and also coplanar with both the trough 130 of the base 112 and lateral apex 122 of the arcuate contour 118.

Figure 5A:
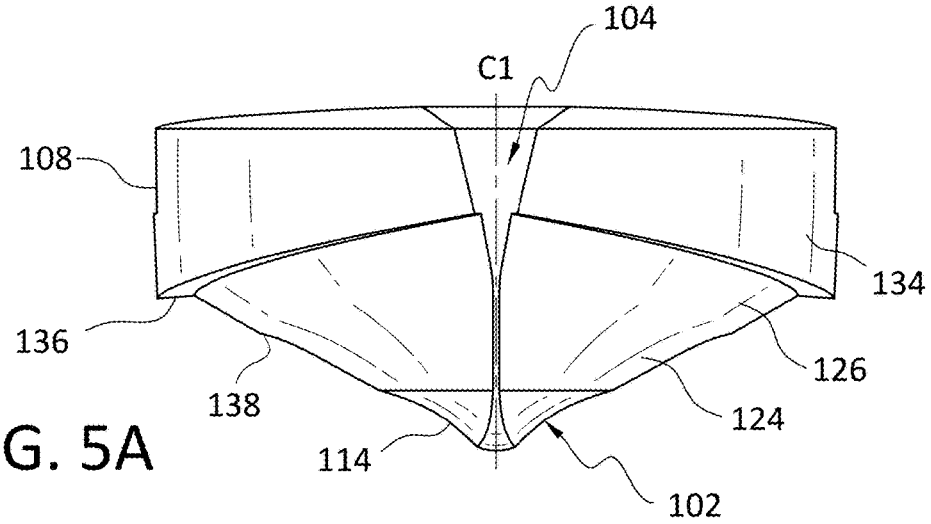
FIG. 5A is a front view of the boat hull with the modular keel.
Figure 5B:
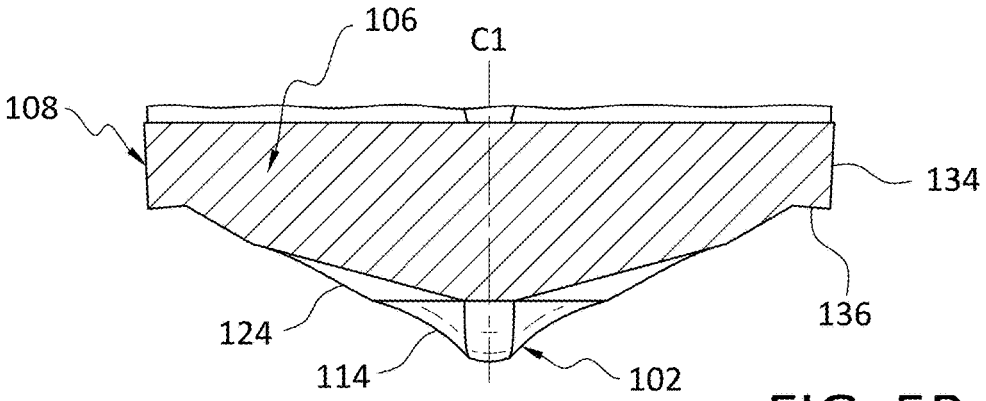
FIG. 5B is a rear view of the boat hull with the modular keel.

Alternative sides or surfaces may be added to the hull 100 as needed. The curved segment 114 is arranged between the base 112 and a circumjacent segment 124 of the hull. The circumjacent segment 124 may feature a concave-up profile, a concave-down profile, or a substantially linear profile. In an embodiment, the circumjacent segment 124 flattens out as it travels down the length L1 of the hull 100 and extends to the stern 106. The circumjacent segment 124 may still be angled, with respect to the waterline plane S1, being inclined athwartship near the stern 106 and away from the planar facet 128. In an embodiment, the hull 100 includes an upper hull side 126 between the circumjacent segment 124 and the first feature guide 136. The upper hull side 126 may begin at the centerline 110 at the bow 104 and taper or blend into a feature guide (e.g., chine) or another side surface. FIG. 5A provides a front view of the bow 104 of boat hull 100 having the modular keel 102; FIG. 5B illustrates a rear view of the stern 106 of boat hull 100.

As depicted, the side 108 includes a lower topside 134 and a first feature guide 136 disposed therebetween. The first feature guide 136 may be a chine. A second feature guide 138 may also be disposed between the lower topside 134 and circumjacent segment 124 of the hull 100. The feature guides 136, 138 provide added stability at rest or while on plane at high speeds. The feature guides 136, 138 provide buoyancy assistance with increased surface area contact against the water. The feature guides 136, 138 may taper toward the centerline 110 at the bow 104 and extend back toward the stern 106.

Figure 6:
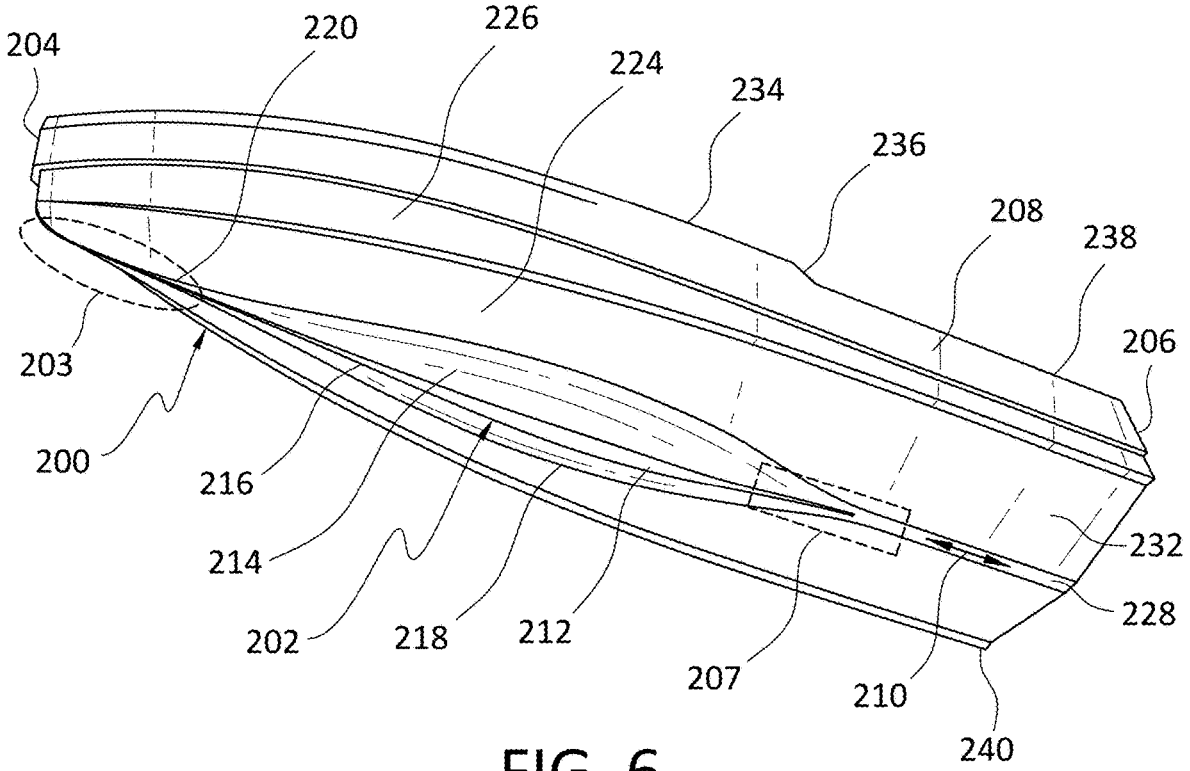
FIG. 6 is a perspective view of an alternative embodiment of a boat hull having the modular keel.
Figure 7:
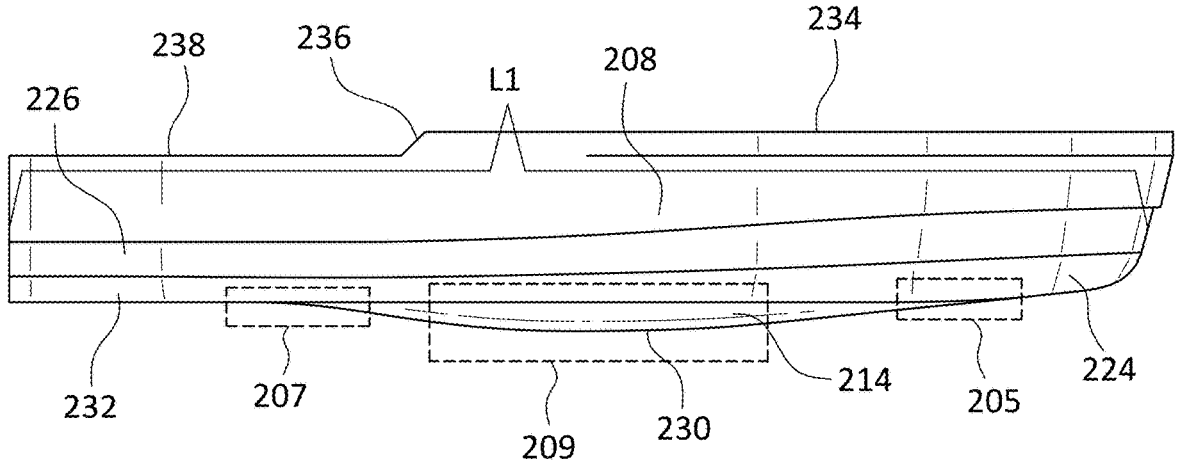
FIG. 7 is a side view of the boat hull in FIG. 6.

FIGS. 6 and 7 illustrates an alternative boat hull 200 according to the present disclosure. Aspects of the modular keel 10, 102 likewise apply to the depicted keel 202 and vice versa. As depicted, the boat hull comprises a top side 208, a lower surface 224 arranged below the top side 208, and a modular keel 202 integrated with the lower surface 224 and formed along a centerline 210 of the hull 200. In an embodiment, a lower topside surface 226 is formed between the lower surface 224 and the top side 208. The hull 200 is symmetrical about the centerline 210. The keel 202 includes a base 212 extending along the centerline 210 and tapering from a planar facet 228 at a stern substructure 232 toward an extended vertex 220 on the centerline 210. The vertex 220 may be defined as a convergence zone of edges and sides being symmetrical about the centerline 210 of the hull 200.

The keel 202 includes curved segments 214 laterally extending from the vertex 220 toward the stern substructure 232. In an embodiment, the curved segment 214 converges with the base 212 at both the vertex 220 and an aft transitional area 207 proximate the planar facet 228. The keel 202 provides a smooth, hydrodynamic transition of water flow from the vertex 220 to the aft transitional area 207, and the aft transitional area 207 is configured to expel water away from the keel 202 in a laminar flow pattern.

The base 212 includes a trough 230 that is defined as the bottom-most extremity of the keel 202 and is symmetrical along the centerline 210. The trough width is arranged to taper toward the vertex 220 and taper toward the aft transitional area 207. The trough height, being defined as the vertical distance between the trough 130 and the arcuate contour 218, decreases in the directions from the traverse plane T1 toward the vertex 220 and also from the traverse plane T1 toward the aft transitional area 207. The curved segment 214 may have a concave-up or concave-down profile defined between the edge 216 and the arcuate contour 218. The lower surface 224 preferably has a linear profile at the stern substructure 232, though it may have a minor curvature.

The keel 202 includes a fore transitional area 205 that is optimized to reduce slamming and spray by creating a concentrated high pressure zone at the front of the keel 202. An aft transitional area 207 is provided to avoid high pressure concentrations while still creating a high pressure zone to lift the corresponding hull and reduce pitching. An intermediate transitional area 209 is arranged between fore and aft transitional areas 205, 207 for optimizing speed and sea keeping requirements. The intermediate transitional area 209 advantageously creates a low pressure zone along the middle section of the keel 202 to dampen the motion of the hull 200 through the waves.

In an embodiment, the top side 208 defines an upper guiding edge 234, a lower guiding edge 238, and a transitional step 236 therebetween. The upper guiding edge 234 may encompass a raised deck or forecastle of the boat. The transitional step 236 leading to a lower deck encompassed by the lower guiding edge 238.

In an embodiment, the boat hull 200 comprises at least one chine 240 formed between top side 208 and keel 202. The chine 240 extends between the bow 204 and stern 206 of the hull 200 and tapers in the forward direction toward the centerline 210. In an embodiment, the modular keel 202 forms a blended bow region 203 with the boat hull 200 wherein the vertex 220 blends into the bow 204.

In an embodiment, the vertex 220 is located between 10% and 30% down a length L1 of the waterline, while the aft transitional area 207 is arranged between 60% and 80% down a length L1 of the waterline. The aft transitional area 207 is formed by the convergence of the base 212, the curved segment 214, and the planar facet 228.

Figure 8:
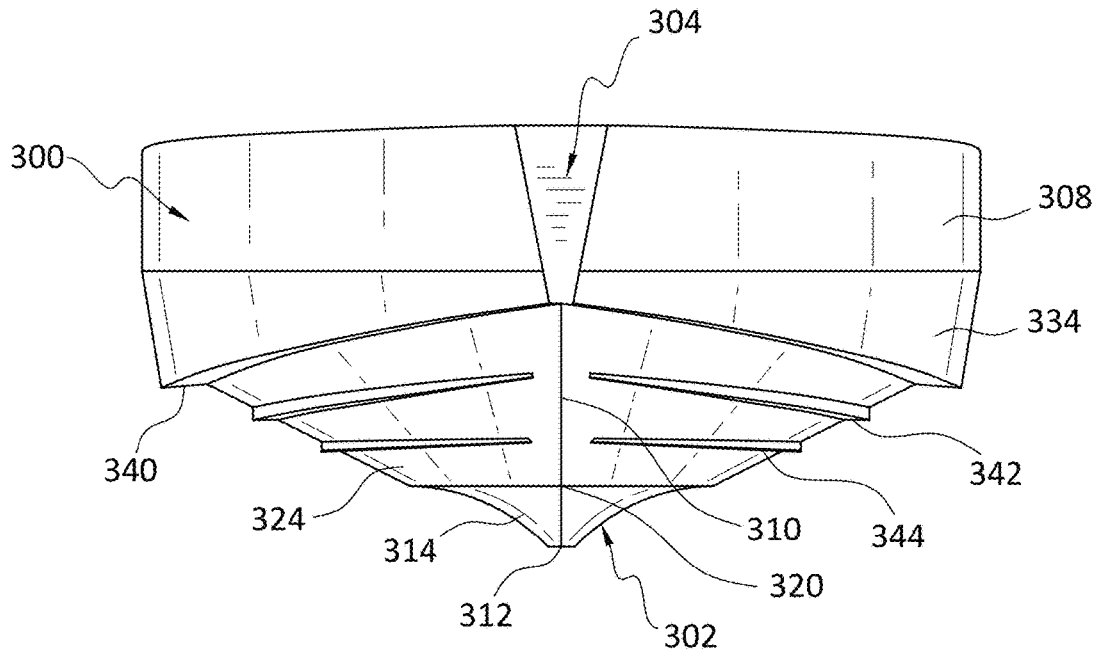
FIG. 8 is a front view of an alternative embodiment of a boat hull with the modular keel.

FIG. 8 illustrates a front view of the bow 304 of a boat hull 300 having a modular keel 302. The keel 302 is symmetrically arranged along a centerline 310 of boat hull 300 and configured to create distinct pressure zone situations to draw the keel 302 back into water after vertical displacement. The keel 302 includes a base 312 extending along a centerline 110, wherein the base 312 tapers in a forward direction to a vertex 320. The keel 302 includes two symmetric curved segments 314, wherein each curved segment 314 is defined between the base 312 and a circumjacent segment 324 of the hull. The curved segment 314 laterally extends from the vertex 320 toward an aft transitional area (e.g., aft transitional area 107) of the keel 302.

In an embodiment, the hull 300 may include one or more strakes 342, 344 formed along the circumjacent segment 324. An upper strake 342 may extend from a stern substructure to a region proximate the centerline 310, though not terminate at the centerline 310. The upper strake 342 may be angled i.e., slanted, with respect to a lower strake 344, wherein the lower strake 344 is substantially parallel with the waterline plane S1. The strakes 342, 344 assist the bow 304 of a boat to be further raised or lifted out of the water, while the resistance the bow 304 encounters while moving forward is greatly reduced. The hull 300 may also include a chine 340 defined between the circumjacent segment 324 and a lower portion 334 of the top side 308. The chine 340 aids in providing lift and increased dynamic stability.

Figure 9:
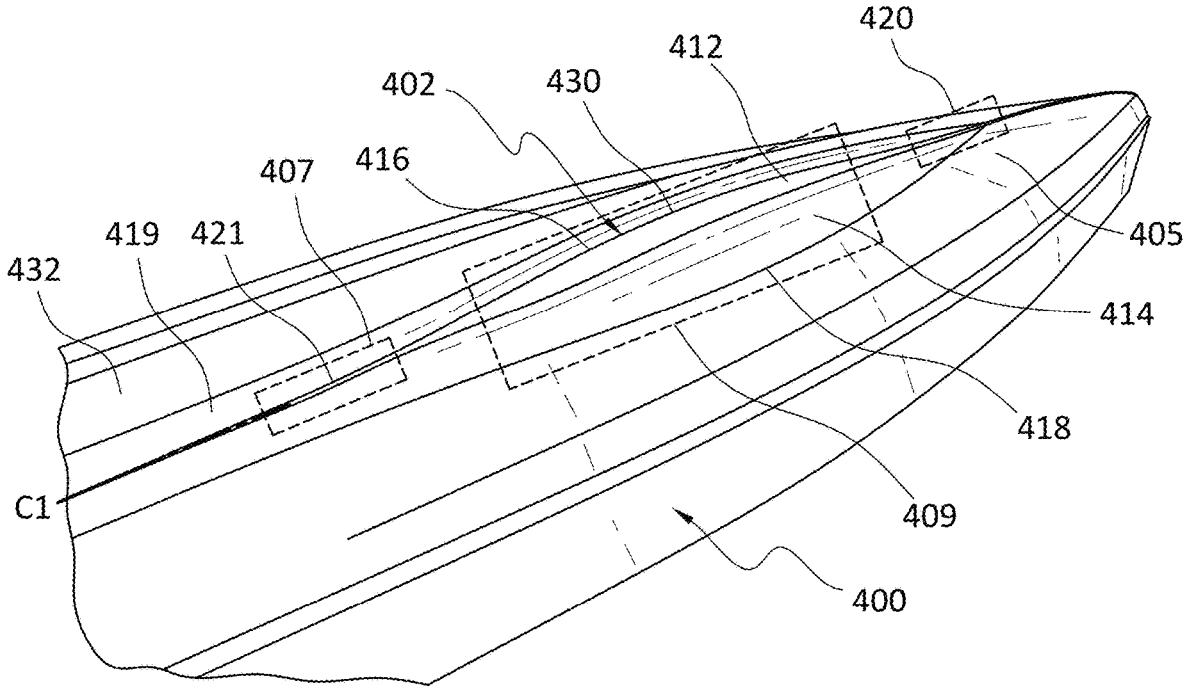
FIG. 9 is a rear perspective view of an embodiment of the modular keel having a base with fore and aft vertices.

FIG. 9 illustrates an embodiment of a hull 400 with the modular keel 402 having a base 412 with first and second vertices 420, 421. The base 412 is defined between opposing edges 416 and includes a trough 430 defined as the lowest point of the keel 402. The base 412 tapers from the trough toward a first vertex 420 at a fore transitional area 405. The base 412 also tapers from the trough toward a second vertex 421 at an aft transitional area 407. Thus, rather than converging at a planar facet, the edges 416 of the base converge at two points that are coplanar with the center plane C1. The keel 402 advantageously works by creating distinct pressure zone situations with transitional areas 405, 407, 409, pulling the keel 402 back into the water, and reducing and mitigating vertical motions that would otherwise aggressively slam traditional vessels downward against the sea surface.

In an embodiment, opposing curved segments 414 are defined between the edges 416 of the base 412 and an arcuate contour 418 that is outboard from the base 412. The curved segment 414 laterally extends from the vertex 420 toward a stern substructure 432. The curved segment 414 is defined as a variable arcuate surface (e.g., concave and/or convex) that tapers from aft to fore. In an embodiment, the arcuate contours 418 of the opposing curved segments 414 transition to parallel peripheries 419 formed along the stern substructure 432.

Figure 10:
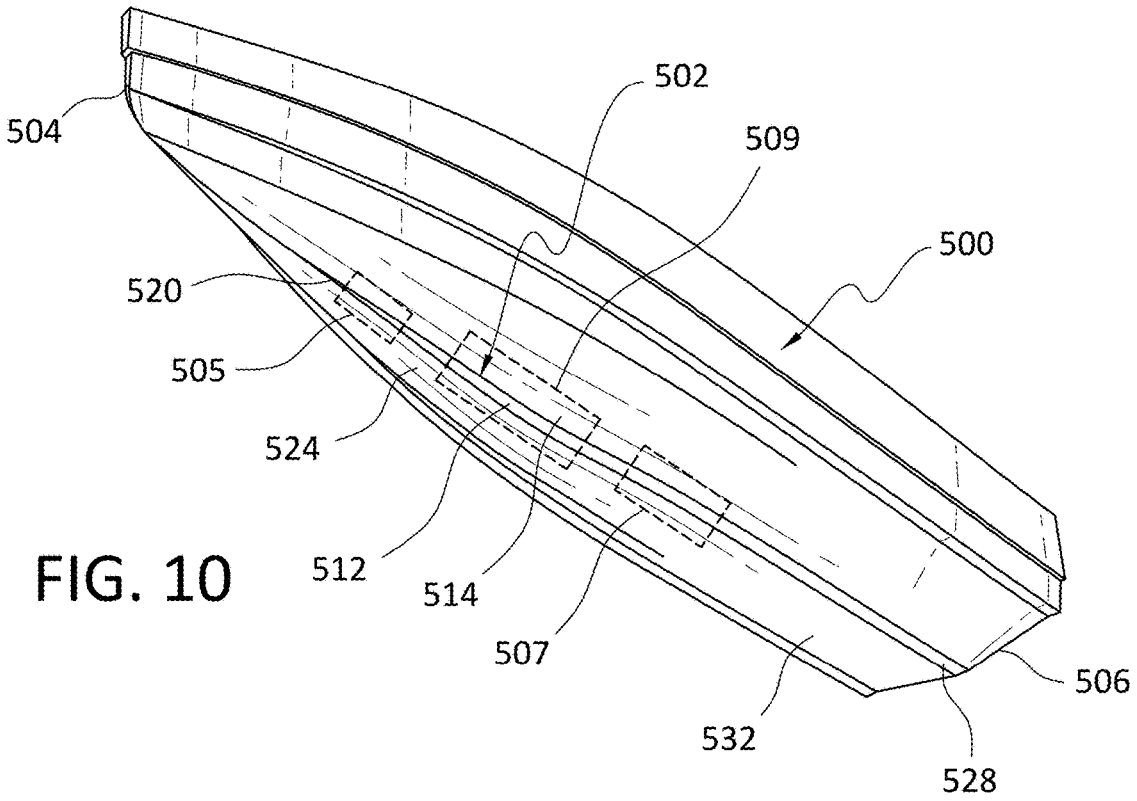
FIG. 10 is a perspective view of a boat hull with an alternative embodiment of the modular keel.
Figure 11:
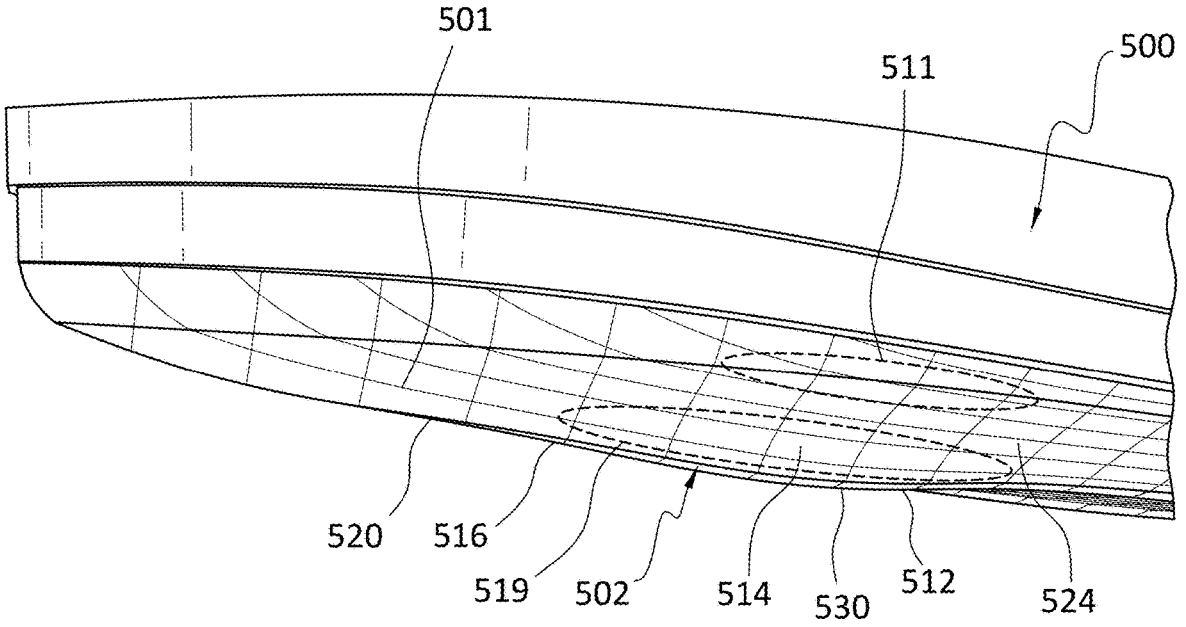
FIG. 11 is a perspective view the alternative embodiment of the modular keel in FIG. 10.
Figure 12:
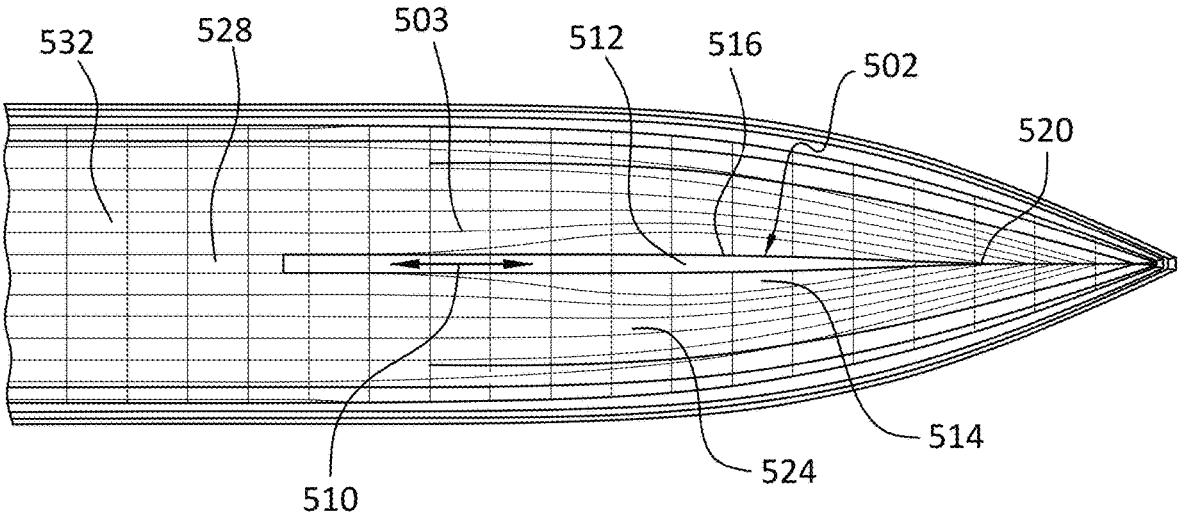
FIG. 12 is a bottom plan view of a boat hull having the modular keel in FIG. 10.

FIGS. 10-12 illustrate a boat hull 500 with an alternative embodiment of the modular keel 502. The keel 502 comprises a base 512 arranged along a centerline 510 and opposing curved segments 514. The keel 502 is defined as a convex deflection of the hull waterlines 503 and buttock lines 501. The keel 502 creates a concentrated high pressure zone forward of the keel 502 in a fore transitional area 505, a low pressure zone along the middle of the keel 502 in an intermediate transitional area 509, and a high pressure zone aft of the keel 502 in an aft transitional area 507. The amount of hydrodynamic pressure against the keel 502 is based on the amount of curvature along the base 512 and the curved segments 514. Exemplary curvature may be observed by the buttock lines 501 and waterlines 503 in FIGS. 11-12. Similar pressure zones are also created on the surrounding hull 500 surface in a blended region 519 of the curved segment 514 and circumjacent segment 524. Thus, rather than a definite arcuate contour (e.g., arcuate contour 118), the curved segment 514 is configured and dimensioned to converge with the circumjacent segments 524 of the boat hull 500 in the blended region 519.

The base 512 tapers toward the bow 504 and includes opposing edges 516 that intersect at the vertex 520 on the centerline 510. The base 512 features a trough 530 defining the lowest point of the keel 502. The continuous extension of the edges 516 toward a stern substructure 532, e.g., to a planar facet 528, provides improved laminar flow pattern of water toward the stern 506.

In an embodiment, the blended region 519 coincides with the intermediate transitional area 509 and creates a low pressure zone. The blended region 519 abuts an adjacent hull-side transition area 511 that is arranged to distribute buoyancy and provide athwartship stability. In an embodiment, the keel 502 is monolithically formed with the hull 500.

Figure 13:
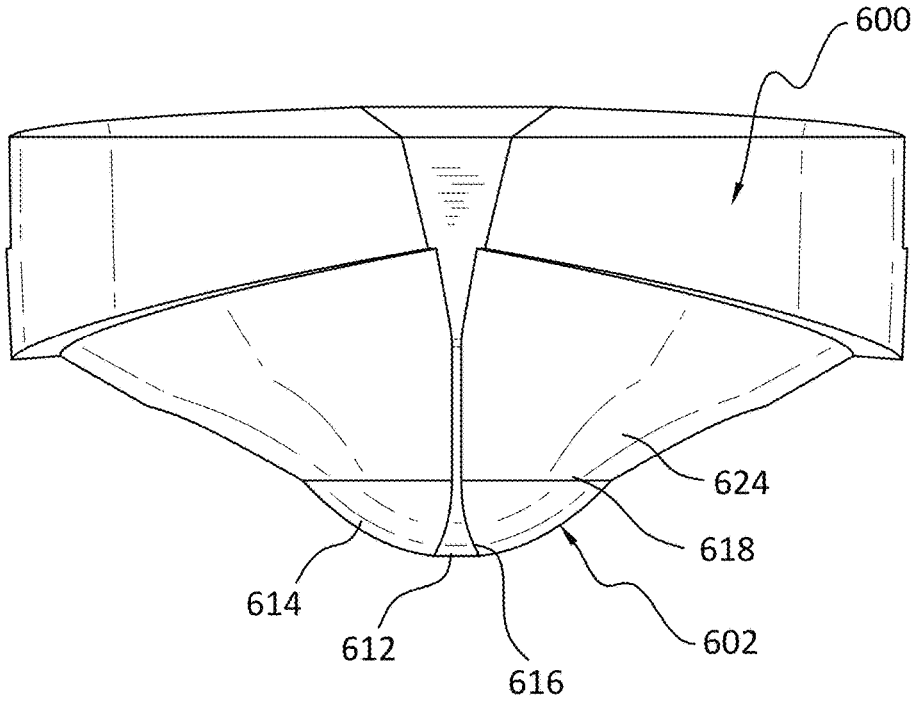
FIG. 13 is a front view of a boat hull having an alternative embodiment of the modular keel.
Figure 14:
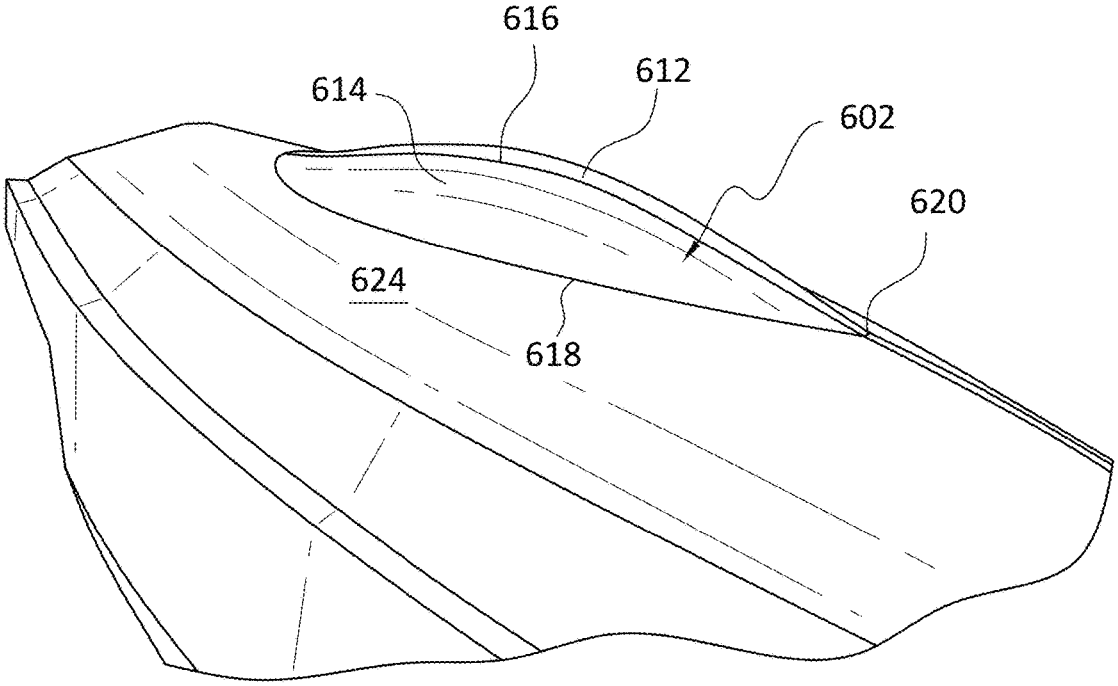
FIG. 14 is a front perspective view of the modular keel in FIG. 13.

FIGS. 13-14 illustrate a boat hull 600 having an alternative embodiment of the modular keel 602. The keel 602 comprises a base 612 defined between opposing edges 616 and opposing curved segments 614 that are concave up. The base 612 tapers from aft to fore and includes converging edges 616 at a vertex 620. Each curved segment 614 is defined between an edge 616 of the base 612 and arcuate contour 618 bordering a circumjacent section 624 of the boat hull 600.

Figure 15:
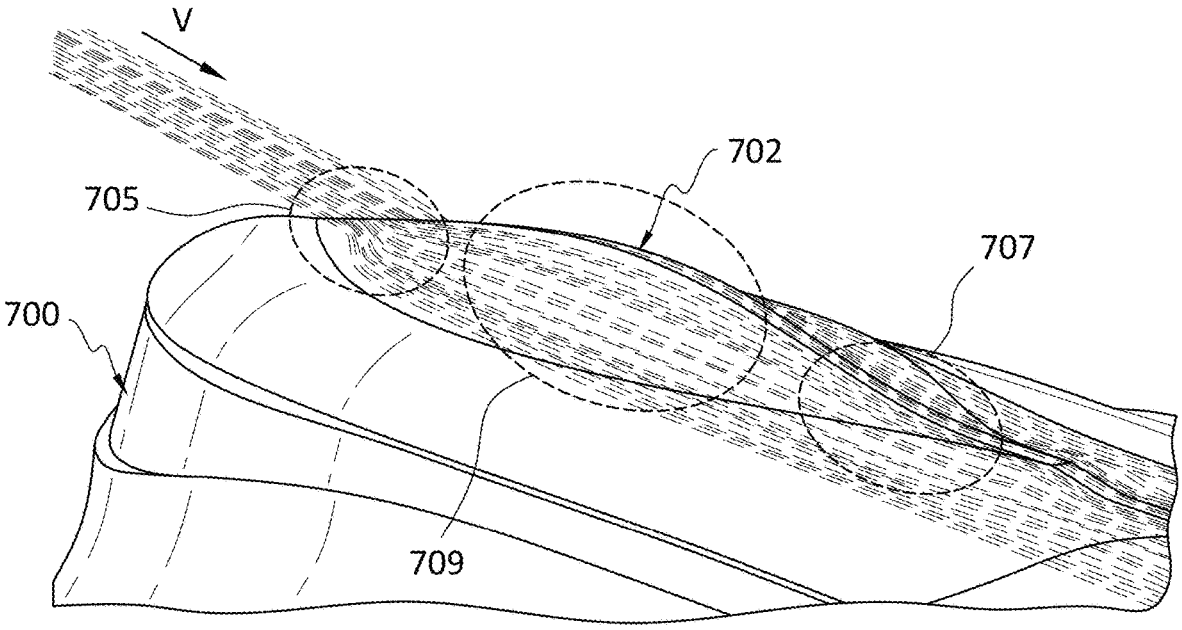
FIG. 15 is a rear perspective view of the modular keel in FIG. 13 and corresponding laminar flow pattern.

FIG. 15 illustrates a water velocity magnitude V against the keel 702 and various transitional areas 705, 707, 709. The fore transitional area 705 is optimized to reduce slamming by creating a concentrated high pressure zone at the front of the keel 702 to help lift the hull and reduce pitching. The aft transitional area 707 is optimized to create a high pressure zone to lift the corresponding hull and reduce pitching. In an embodiment, the fore transitional area 705 is configured and dimensioned to create increased hydrodynamic pressure concentrations in the first high pressure zone relative to the second high pressure zone in the aft transitional area 707. The intermediate transitional area 709 is arranged between fore and aft transitional areas 705, 707 and is optimized for speed and sea keeping requirements. The intermediate transitional area 709 creates a low pressure zone along the middle section of the keel 702 to dampen the motion of the hull 700 through the waves. The observations of the water velocity magnitude V from FIG. 15 may be applied to any of the aforementioned embodiments.

It is to be understood that not necessarily all objects or advantages may be achieved under any embodiment of the disclosure. Those skilled in the art will recognize that keels may be embodied or carried out in a manner that achieves or optimizes one advantage or group of advantages as taught herein without achieving other objects or advantages as taught or suggested herein.

The skilled artisan will recognize the interchangeability of various disclosed features. Besides the variations described herein, other known equivalents for each feature can be mixed and matched by one of ordinary skill in this art to build and use modular keels and hulls under principles of the present disclosure. It will be understood by the skilled artisan that the features described herein may be adapted to other methods and types of water vessels.

It is intended that the present disclosure should not be limited by the disclosed embodiments described above and may be extended to other applications that may employ the features described herein.

The invention claimed is:

1. A modular keel for a boat hull, the keel comprising:

a base extending along a centerline of the hull, the base tapering aft to fore toward a vertex on the centerline, the vertex being formed by converging edges of the base;

opposing curved segments laterally extending from the vertex toward a stern substructure, the opposing curved segments being outboard from the base, wherein each curved segment is defined between an edge of the base and an arcuate contour;

a fore transitional area formed at the vertex and arranged to create a first high hydrodynamic pressure zone against the keel during forward movement of the boat hull; and an aft transitional area formed at the stern substructure and arranged to create a second high hydrodynamic pressure zone against the keel during forward movement of the boat hull;

wherein the fore transitional area is configured and dimensioned to create increased hydrodynamic pressure concentrations in the first high pressure zone relative to the second high pressure zone in the aft transitional area;

wherein the arcuate contour extends from the vertex to a planar facet at the stern substructure.

2. The keel of claim 1, wherein the aft transitional area is further arranged to expel water away from the keel in a laminar flow pattern during forward movement of the boat hull.

3. The keel of claim 1 further comprising an intermediate transitional area formed between the vertex and the stern substructure and arranged to create a low pressure zone along the keel to dampen motion of the hull in waves.

4. The keel of claim 1, wherein the aft transitional area is configured and dimensioned to reduce hydrodynamic pressure concentrations along the opposing curved segments from fore to aft.

5. The keel of claim 1, wherein each opposing curved segments includes a variable arcuate surface that tapers between an edge of the base and a circumjacent segment of the hull to the vertex.

6. The keel of claim 1, wherein the base further tapers fore to aft toward a rear vertex on the centerline, the rear vertex being formed by converging edges of the base.

7. The keel of claim 6, wherein the aft transitional area contains the rear vertex.

8. The keel of claim 1, wherein each opposing curved segment has a concave-up profile.

9. The keel of claim 1, wherein each opposing curved segment has a greater curvature proximate to a trough of the base than to the vertex.

10. The keel of claim 1, wherein the aft transitional area is arranged to create a forward thrust component on the hull based on curvature of both the base and opposing curved segments.

11. The keel of claim 1, wherein the keel is configured and dimensioned to force water to exit the opposing curved segments in a laminar flow pattern toward the stern substructure during forward movement of the boat hull.

12. A keel for a boat hull, the keel comprising:

a base extending along a centerline of the boat hull between a bow and a stern, wherein the base tapers from a planar facet at a stern substructure toward a vertex on the centerline;

a curved segment defined between an edge of the base and an arcuate contour, the curved segment laterally extending from the vertex toward the planar facet, wherein the arcuate contour extends from the vertex to a planar facet at the stern substructure;

wherein the base includes a trough defining a bottommost extremity of the keel along the centerline;

wherein the curved segment is formed as paraboloid surface having a maximum point amidship and coplanar with the trough of the base and a lateral apex of the arcuate contour.

13. The keel of claim 12, wherein the curved segment has a concave-down profile.

14. The keel of claim 12, wherein an aft transitional area is arranged along the keel to create a forward thrust component on the hull based on curvature of both the base and opposing curved segments.

15. The keel of claim 12, wherein the boat hull is configured as one of the following: a V-shaped hull, flat bottom hull, displacement hull, planing hull, multihull, round bottom hull, catamaran hull, pontoon hull, cathedral hull, or trimaran hull.

16. The keel of claim 12, wherein the vertex is arranged between 15% and 30% down a waterline length of the hull.

17. The keel of claim 12, wherein the edge of the base continuously extends and converges with a periphery of the planar facet.

18. A modular keel arranged along a centerline of boat hull for displacing a bow wave towards a stern and creating distinct hydrodynamic pressure zone situations to draw the keel back into water, the keel comprising:

a base extending along the centerline, wherein the base tapers aft to fore toward a vertex coplanar with the centerline, the vertex being defined by opposing edges of the base;

opposing curved segments arranged outboard from the base and laterally extending from the vertex toward a stern substructure, wherein each curved segment is defined between an edge of the base and an arcuate contour;

a fore transitional area formed at the vertex and arranged to create a first high pressure zone;

an intermediate transitional area formed between the vertex and the stern substructure and arranged to create a low pressure zone along the keel; and an aft transitional area formed at the stern substructure and arranged to create a second high pressure zone;

wherein the curved segments are configured and dimensioned to converge with circumjacent segments of the boat hull in a blended region;

wherein the arcuate contour extends from the vertex to a planar facet at the stern substructure; and wherein the arcuate contour blends with a periphery of the planar facet, the periphery being adjacent to a stern substructure.

19. The keel of claim 18, wherein the blended region coincides with the intermediate transitional area.

20. The keel of claim 18, wherein the blended region abuts an adjacent hull-side transition area arranged to distribute buoyancy and provide athwartship stability.

* * * * *